US007337060B2

(12) United States Patent
Kienle et al.

(10) Patent No.: US 7,337,060 B2
(45) Date of Patent: Feb. 26, 2008

(54) METHOD, COMPUTER PROGRAM AND CONTROL UNIT FOR OPERATING AN INTERNAL COMBUSTION ENGINE

(75) Inventors: Karin Kienle, Weil der Stadt (DE); Volker Stuerzl, Stuttgart (DE); Martin Lunt, Markgroeningen (DE); Christian Tischer, Hemmingen (DE); Dieter Buchholz, Sachsenheim (DE); Andreas Traub, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 160 days.

(21) Appl. No.: 10/545,127

(22) PCT Filed: Feb. 19, 2004

(86) PCT No.: PCT/EP2004/050166

§ 371 (c)(1),
(2), (4) Date: May 4, 2006

(87) PCT Pub. No.: WO2004/074665

PCT Pub. Date: Sep. 2, 2004

(65) Prior Publication Data

US 2007/0106452 A1 May 10, 2007

(30) Foreign Application Priority Data

Feb. 21, 2003 (DE) ..... 103 08 459

(51) Int. Cl.
*G06G 19/00* (2006.01)
*F02D 41/24* (2006.01)

(52) U.S. Cl. ..... 701/115; 701/102; 123/486

(58) Field of Classification Search ..... 701/1, 701/29, 36, 101–106, 110–115; 123/478, 123/480, 486, 672, 674, 679
See application file for complete search history.

(56) References Cited

U.S. PATENT DOCUMENTS

| | | | | |
|---|---|---|---|---|
| 4,517,948 | A * | 5/1985 | Kaji et al. | 123/674 |
| 4,658,789 | A * | 4/1987 | Morita | 123/406.36 |
| 4,980,845 | A * | 12/1990 | Putrow et al. | 701/102 |
| 6,009,372 | A | 12/1999 | Baker et al. | |
| 6,161,383 | A * | 12/2000 | Aschner et al. | 60/602 |
| 6,810,314 | B2 * | 10/2004 | Tashiro et al. | 701/48 |

FOREIGN PATENT DOCUMENTS

| | | |
|---|---|---|
| DE | 197 09 318 | 9/1998 |
| DE | 198 50 587 | 5/2000 |
| EP | 0 507 072 | 10/1992 |
| EP | 1 074 719 | 2/2001 |

* cited by examiner

*Primary Examiner*—Willis R. Wolfe, Jr.
(74) *Attorney, Agent, or Firm*—Kenyon & Kenyon LLP

(57) ABSTRACT

A method for triggering an internal combustion engine of a certain type according to a state machine is provided, in which a possible operating state of the engine, which is assigned to a layer n of the state machine, is first set. In an additional layer (n+1), sub-states to the previously determined operating state are specified. For triggering different type engines, the method provides that the state machine has at least two groups of layers, the first group of layers representing operating states that the engine of the certain type has in common with engines of another type, and the second group of layers representing operating states that are specific to the engine of the certain type.

26 Claims, 3 Drawing Sheets

METHOD, COMPUTER PROGRAM AND CONTROL UNIT FOR OPERATING AN INTERNAL COMBUSTION ENGINE

FIELD OF THE INVENTION

The present invention relates to a method for operating an internal combustion engine according to a state machine, and also relates to a computer program and a control unit for carrying out the method.

BACKGROUND INFORMATION

State machines are known in the art, in particular in software development. In general, they graphically represent different states of a system. The individual states of the system are represented by parameters and values assigned thereto, which are queriable by software modules. Such state machines, e.g., as shown in FIG. 4, are known also for internal combustion engines; in this case the state machines specify several possible operating states, which are represented in FIG. 4 by solid dots, for operating the internal combustion engine of the certain type, and permitted transitions between these operating states. The operating states in the state machines may be grouped into a plurality of layers (1 . . . n, n+1, . . . N). The layers are hierarchically structured in such a way that at least one layer n is superordinated by at least one additional layer n+1, which includes at least one sub-state for an operating state associated with layer n.

Known state machines for internal combustion engines have successively increased over time; they have been further and further expanded as needed for special individual applications. This is the reason why existing state machines for internal combustion engines are now very complex and awkward. When known state machines are to be used for individual applications in conjunction with internal combustion engines of a certain type, it is now indispensable that with the implementation of the known state machines a plurality of components or sub-systems, which would not be absolutely necessary for the specific individual applications, must also be installed.

It is an object of the present invention to provide a method, computer program and control unit such that simple and lean adaptation to various internal combustion engines of different types is made possible.

SUMMARY

According to the present invention, layer n and all layers hierarchically superordinated thereto in the hierarchical structure of the state machine each represent operating states which the engine of the certain type has in common with engines of another type, and the additional layer and all layers subordinated thereto in the hierarchical structure of the state machine represent operating states which are specific to the engine of the certain type.

Engines of different types may be diesel engines and gasoline engines, for example.

Due to the division of the layers of the state machine according to the present invention, when switching from one type of engine used to another, it is only necessary to replace or adapt those layers in the state machine that are specific to a certain engine. All other layers of the state machine remain unaffected by the change. These other layers/software and engine control unit parts, which depend only on the generic (reusable) layers of the state machine, may be used in different types of engines without adaptation.

In other words, when switching from one type of engine used to another, it is now no longer necessary to transfer the entire state machine, which basically includes the operating states of a plurality of engines of different types. Instead, in a new engine type, it is possible to use initially only those layers of the state machine which represent operating states that are usable for multiple engines, i.e., are engine-type-independent. Only those layers of the additional layers of the state machine which are suitable for the specific engine used need to be transferred to the new type. Even within a selected additional layer, individual un-needed operating state modules may be eliminated or replaced. Other additional layers which are basically available in the state machine may be omitted. In this way, efficient adaptation of the state machine to a desired application is possible.

According to a first exemplary embodiment of the present invention, the state machine for the internal combustion engine has four layers. The first layer represents an operating state "engine trigger." The operating states "start," "normal operation," and "after-run" are defined as sub-states of the operating state "engine trigger" in the second layer. The third layer in turn represents sub-states of the operating states of layer 3. It includes the sub-states "standby," "ready," "start phase," "idle," "accelerate," "coast," and "end." Finally, the fourth layer includes the "preheat" or "no preheat" states as sub-states of the "ready" operating state in the third layer. In this exemplary embodiment, the first through third layers represent operating states that are non-specific to the engine of the certain type, and the fourth layer includes operating states which are specific to the engine of the certain type.

Other advantageous example embodiments of the method are provided, in which the state machine is designed in such a way that a transition between individual operating states represented by it is only possible under certain circumstances. It is furthermore advantageous if the method provides that the state machine represents not only operating states of the engine, but also different operating states of an engine control unit.

The present invention also provides a computer program for the control unit of the internal combustion engine and by the control unit itself.

DETAILED DESCRIPTION

Figure 1:
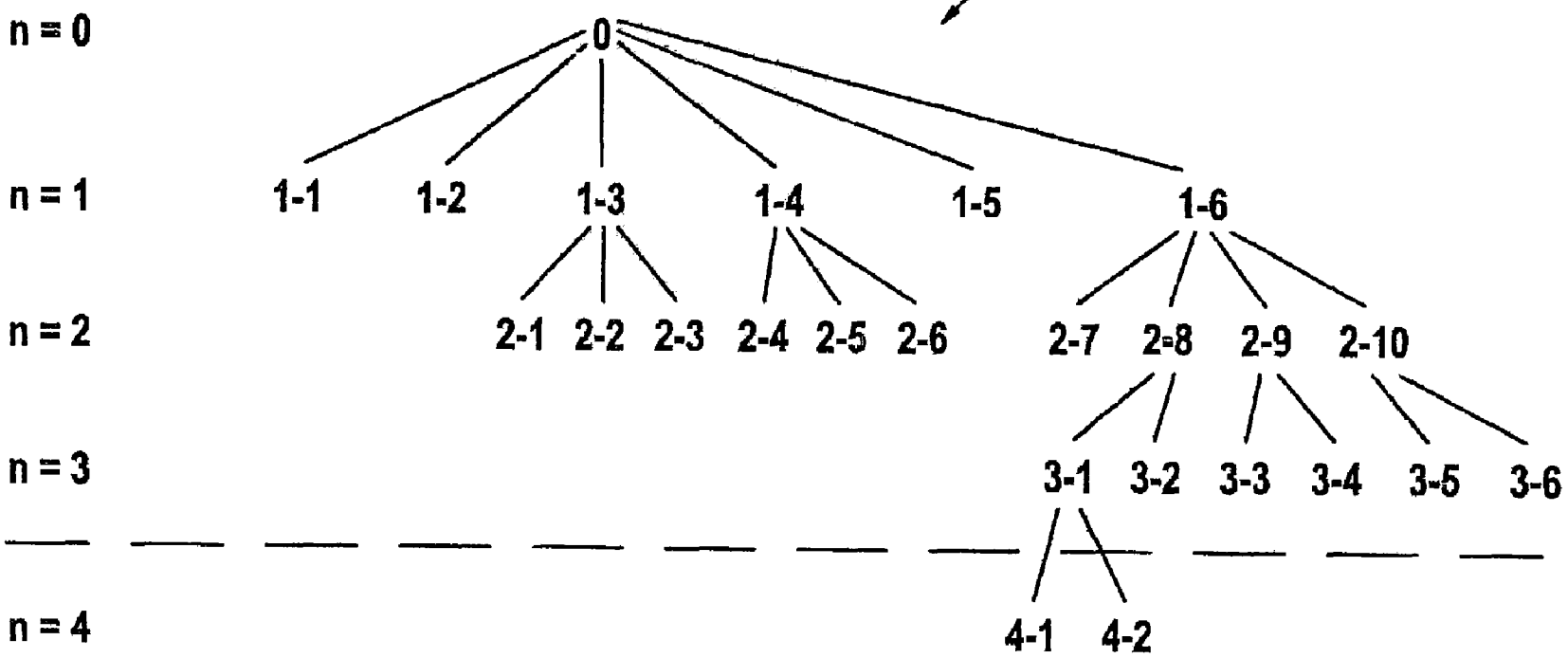
FIG. 1 shows the basic hierarchical structure of a state machine according to the present invention.

FIG. 1 shows an example of a basic structure of a state machine 12 for triggering an engine of a certain type according to the present invention.

Figure 3:
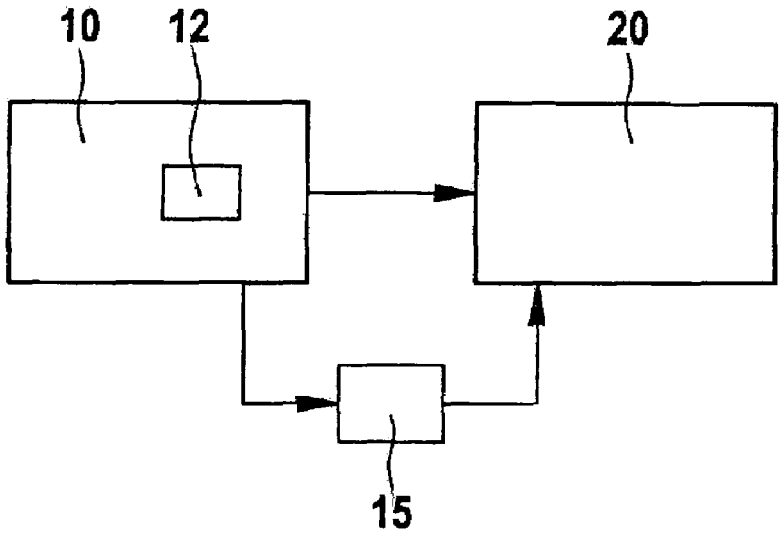
FIG. 3 shows a control unit and an engine.
Figure 4:
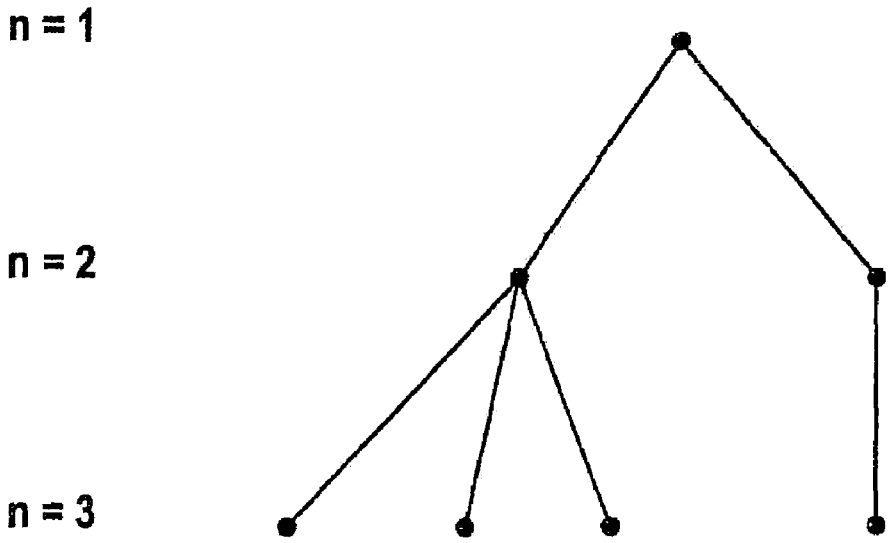
FIG. 4 shows generic, hierarchically structured layers of a state machine.

FIG. 3 shows an engine of a certain type 20, which is triggered by a control unit 10 according to the state machine 12 stored therein. A starter 15 triggered by control unit 10 is used for starting engine 20.

Basic structure 12 of the state machine shown in FIG. 1 has a total of five layers n=0 . . . 4. An uppermost layer n=0 represents the operating state "engine trigger." This is a superordinate concept, i.e., state of all possible operating states of the engine and the control unit. In the following, initially only the different operating states of the engine will be discussed; a discussion of the different operating states of the control unit follows further below.

The uppermost operating state in layer n=1 is "engine trigger" 1-6. In a layer n=2 below the first layer, various operating states of the engine, specifying the superordinate operating state "engine trigger," are combined; these are the operating states "standby" 2-7 (optional), "start" 2-8, "normal operation" 2-9, and "after-run" 2-10. The term "start" combines all sub-states of the engine that are used for preparing the engine for start, as well as for executing the start. These sub-states are the states "ready" 3-1 and "start phase" 3-2, which are specified in a layer n=3. Similarly, in third layer n=3, the sub-states "idle" 3-3 and "accelerate" 3-4 are described as sub-states for the superordinate state "normal operation" 2-9 in second layer n=2. Third layer n=3 includes the states "start-up" 3-5 and "end" 3-6 as substates to the superordinate operating state "after-run" 2-9 of the engine as it is referred to in the second layer. Finally, the state machine shown in FIG. 1 has a fourth layer n=4, in which the state "ready" from third layer n=3 is specified in more detail, for example. For example, in the case of diesel engines, it may be checked during this "ready" state whether a "preheating state" 4-1 or a "no preheating" state 4-2 has been reached.

According to the present invention, the first through third layers n=1 to 3, when they concern the engine, rather than the control unit, represent only the operating states which the engine of a certain type, for example, a gasoline engine, has in common with engines of another type, for example, diesel engines. In contrast, the fourth layer n=4 represents predominantly operating states which are specific to engines of certain types such as diesel engines or gasoline engines.

The individual operating states mentioned so far and the possible transitions between these operating states during the operation of the engine are described in detail below with reference to FIG. 2.

Figure 2:
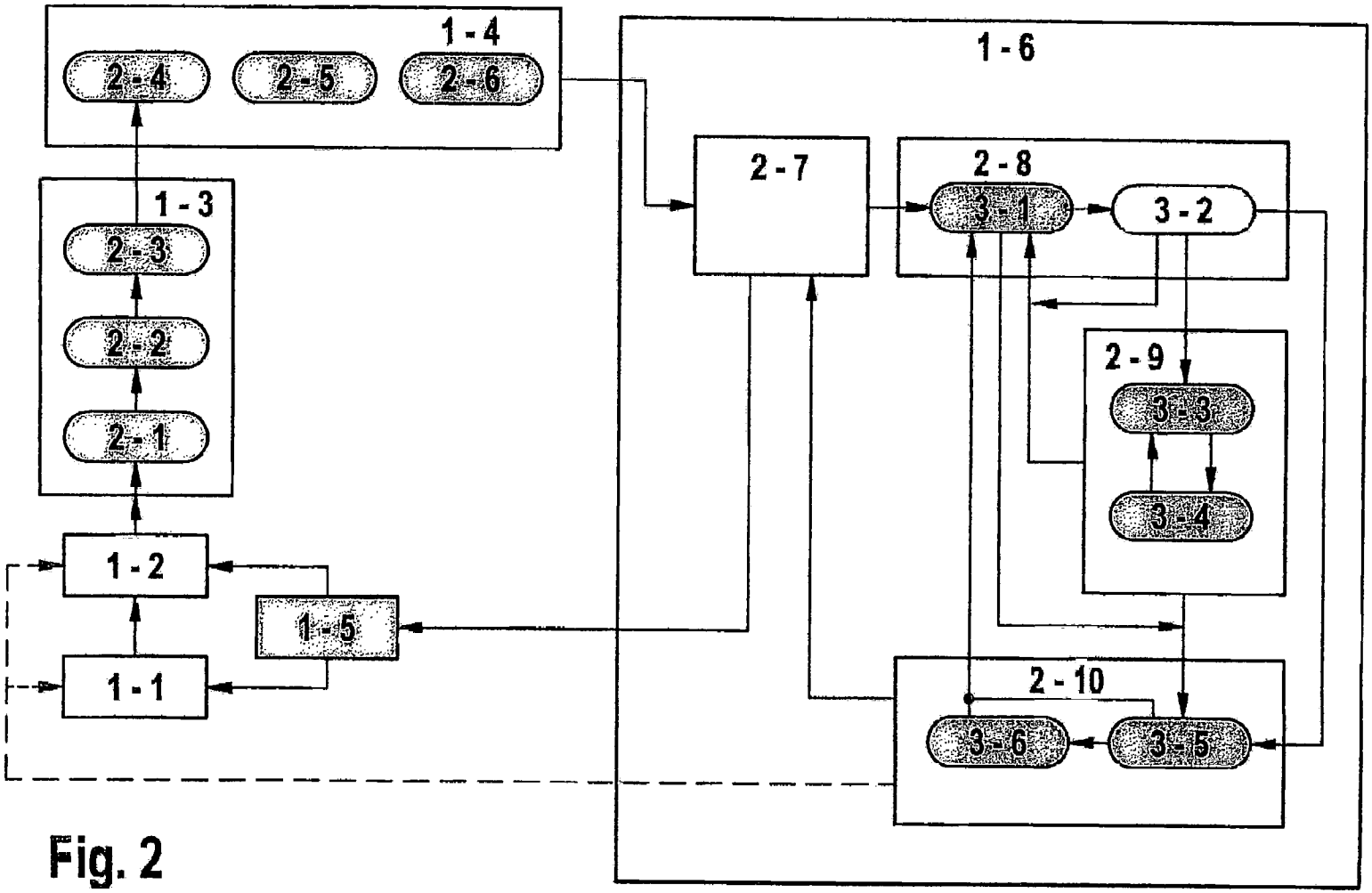
FIG. 2 shows the operating states of the engine and the engine control unit represented by the state machine.

As is evident from FIG. 2, all possible operating states of the engine of the certain type are represented within the state "engine trigger" 1-6, which includes the sub-states "standby" 2-7, "start" 2-8, "normal operation" 2-9, and "after-run" 2-10. "Standby" state 2-7 is a power-saving mode in which certain electrically operated secondary units of the engine may be switched off. In the "standby" state, communication with other control units via a network is possible. In addition, during this state, the engine operating temperature and/or the throttle valve spring may be monitored, fuel may be pre-supplied to the engine, or the emergency shutdown may be tested, for example.

When the ignition of the vehicle occurs, i.e., the engine is turned on during "standby" state 2-7 or some other equivalent information is supplied to the control unit, the engine controller exits the "standby" state and switches to a "ready" state 3-1; engine 20 may then immediately start. In the "ready" state, power consumers still may be monitored; in diesel engines, the preheat process may be performed in the "ready" state according to a subordinate layer n=4. However, as soon as starter 15 of the engine is activated and a rotational speed of the engine which is greater than a predefined threshold value Thr0 has been detected, the system exits this "ready" state 3-1 and the engine switches to "start phase" state 3-2. Alternatively, if the ignition is turned off during "ready" state 3-1, no transition to the "start phase" state, but to "coast" state 3-5 takes place.

"Start phase" state 3-2 is used for making the engine bring itself to run. If this cannot be done, i.e., if the engine stalls, which means that the rotational speed of the engine remains below a predefinable threshold value Thr1 for a certain minimum period of time, the system jumps back to "ready" state 3-1. In contrast, if the start phase is successfully completed, i.e., the rotational speed of the engine exceeds a predefinable second threshold value Thr2, state machine 12 transitions within second layer n=2 from operating state "start" 2-8 to operating state "normal operation" 2-9.

More precisely, after the start phase the engine first transitions into an "idle" state 3-3 in third layer n=3 of the state machine, as illustrated in FIG. 2. Depending on the intent of the driver of a vehicle in which the engine is installed, or depending on the driving situation, the operating state of the engine changes during "normal operation" state 2-9 between the sub-states "idle" 3-3 and "accelerate" 3-4. If engine 20 stalls while it is in "normal operation," the system transitions into operating state "start" 2-8 within layer n=2, more precisely, into "ready" state 3-1 within layer n=3. In contrast, if "normal operation" state 2-9 is terminated properly by switching off the ignition, the engine transitions into an "after-run" state 2-10 in layer n=2. After the ignition is turned off, within operating state "after-run" 2-10, the engine first transitions into "coast" state 3-5 in layer n=3. This state is characterized in that, although the ignition is turned off, the engine is still coasting, i.e., its rotational speed is still different from zero. Engine 20 does not exit this "coast" state 3-5 going into an "end" state 3-6 in third layer n=3 until the rotational speed of the engine drops below a predefined threshold value Thr3. This state characterizes the final shutoff of the engine, where certain units such as a fan may still run, for example, to cool the engine, although the ignition has been switched off and the rotational speed is zero.

As soon as the "after-run" state is terminated, the engine switches to "standby" state 2-7 within the second layer. This occurs if the ignition is not turned on again during "after-run" state 2-10.

However, if the ignition is turned on again during this "after-run" state 2-10 in second layer n=2, there are three alternative procedures for controlling the engine. A first alternative is the engine switching from "after-run" state 2-10 to "start" state 2-8 within second layer n=2. With respect to third layer n=3, it is irrelevant for this changeover whether engine 20 is in "coast" state 3-5 or "end" state 3-6 when the ignition is turned on again; in either case, the engine goes into "ready" state 3-1 when the ignition is turned on. Alternatively, there is the possibility to exit "engine trigger" state 1-6 and go into a "reset" state 1-2 of control unit 10 for engine 20. As a third alternative, there is the possibility to go into an "off" state 1-1 of control unit 10.

In addition to operating state "engine trigger" 1-6, which, as described above, includes all essential operating states of the engine, state machine 12 may also include different operating states of engine control unit 10. These are, as FIG. 2 shows, the states "off" 1-1, "reset" 1-2, "boot" 1-3, "initialize" 1-4, and "shut down" 1-5. As is evident from the structure of the reference symbols, these states are situated at the same hierarchical level as "engine trigger" state 1-6 of first layer n=1 in state machine 12.

The transitions between these individual states of engine control unit 10, as well as the transitions between these states and the above-described states of the engine, are briefly described below.

The context for discussing the above-described state machine 12 is a situation in which a computer or a microcontroller in control unit 10, on which a computer program for executing the above-described and claimed method runs, is off. Provided control unit 10, together with engine 20, is installed in a vehicle, the computer is off, for example, as long as the doors of the vehicle, e.g., the driver's door, are still closed or another defined wake-up event has not yet occurred. Such an "off" state is labeled in FIG. 2 with the reference symbol 1-1. However, as soon as the driver's door, for example, is opened, a switch is actuated, which causes control unit 10 to exit this state 1-1 and go into a "reset" state 1-2. During this state 1-2, control unit 10 is set at a predefined initial condition. Control unit 10 then automatically goes from "reset" state 1-2 to "boot" state 1-3 in which the control unit is started up. Within the "boot" state, control unit 10 sequentially runs through the states "pre-initialize" 2-1, "speed initialize" 2-2, and "post-initialize" 2-3. After terminating "boot" state 1-1, control unit 10 automatically goes into "initialize" state 1-4, in which different adaptations take place and in particular interim values are preassigned to certain parameters. This takes place by sequentially running through the states "standard boot" 2-4, "customer boot" 2-5, and "operating system preparation" 2-6. At the end of the "initialization" process, control unit 10 automatically goes into "engine trigger" state 1-6 in first layer n=1. More precisely, the control unit then goes over to "standby" state 2-7 in layer n=2.

The engine is normally started after the ignition is turned on from "standby" state 2-7, as described in detail above. In addition, different conditions may be pre-programmed, under which conditions the engine goes from "standby" state 2-7 not into "ready" state 3-1, but into "shut down" state 1-5 of control unit 10. This is the case, for example, if "standby" state 2-7 was assumed after exiting "after-run" state 2-9. The control unit is prepared for shutoff in the "shut down" state. When the "shut down" state has been terminated, the control unit goes automatically into "off" state 1-1. However, if the ignition is turned on again during the "shut down" state or another equivalent event occurs, control unit 10 goes into "reset" state 1-2 to go automatically from there into the "boot" state as described above.

What is claimed is:

1. A control unit for controlling operation of an internal combustion engine of a first type according to a state machine which defines a plurality of different operating states for the internal combustion engine of the first type and permitted transitions among the plurality of different operating states, comprising:

a means for grouping the plurality of different operating states into a plurality of differently-ranked hierarchical layers of the state machine, wherein for at least a first hierarchical layer, at least a second hierarchical layer that includes at least one sub-state of an operating state associated with the first hierarchical layer is subordinated to the first hierarchical layer; and a means for operating the internal combustion engine of the first type according to at least one of the plurality of different operating states;

wherein the first hierarchical layer and all additional hierarchical layers superordinated to the first hierarchical layer represent operating states which the internal combustion engine of the first type has in common with an internal combustion engine of a different type, and wherein the second hierarchical layer and all additional hierarchical layers subordinated to the second hierarchical layer represent operating states which are specific to the internal combustion engine of the first type.

2. A computer-readable storage medium containing a computer-executable program for controlling a control unit for an internal combustion engine of a first type according to a state machine which defines a plurality of different operating states for the internal combustion engine of the first type and permitted transitions among the plurality of different operating states, the computer-executable program performing control of the following:

grouping the plurality of different operating states into a plurality of differently-ranked hierarchical layers of the state machine, wherein for at least a first hierarchical layer, at least a second hierarchical layer that includes at least one sub-state of an operating state associated with the first hierarchical layer is subordinated to the first hierarchical layer; and operating the internal combustion engine of the first type according to at least one of the plurality of different operating states;

wherein the first hierarchical layer and all additional hierarchical layers superordinated to the first hierarchical layer represent operating states which the internal combustion engine of the first type has in common with an internal combustion engine of a different type, and wherein the second hierarchical layer and all additional hierarchical layers subordinated to the second hierarchical layer represent operating states which are specific to the internal combustion engine of the first type.

3. The computer-readable storage medium as recited in claim 2, wherein the plurality of differently-ranked hierarchical layers include at least the following operating states:

| hierarchical layer n = | operating states |
|---|---|
| 1 | "engine trigger" |
| 2 | "standby" |
| | "start" |
| | "normal operation" |
| | "after-run" |
| 3 | "ready" |
| | "start phase" |
| | "idle" |
| | "accelerate" |
| | "coast" |
| | "end" |
| 4 | "preheat" |
| | "no preheat" |

wherein the "standby," "start," "normal operation," and "after-run" operating states are sub-states of the "engine trigger" operating state, and wherein the "idle" and "accelerate" operating states are sub-states of the "normal operation" operating state, and wherein the "coast" and "end" operating states represent sub-states of the "after-run" operating state, and wherein the "preheat" and "no preheat" states are sub-states of the "ready" operating state, and wherein hierarchical layers n=1, 2 and 3 represent operating states which the internal combustion engine of the first type has in common with the internal combustion engine of a different type, and wherein hierarchical layer n=4 represents operating states that are specific to the internal combustion engine of the first type.

4. A method for operating an internal combustion engine of a first type according to a state machine which defines a plurality of different operating states for the internal combustion engine of the first type and permitted transitions among the plurality of different operating states, comprising:

grouping the plurality of different operating states into a plurality of differently-ranked hierarchical layers of the state machine, wherein for at least a first hierarchical layer, at least a second hierarchical layer that includes at least one sub-state of an operating state associated with the first hierarchical layer is subordinated to the first hierarchical layer; and operating the internal combustion engine of the first type according to at least one of the plurality of different operating states;

wherein the first hierarchical layer and all additional hierarchical layers superordinated to the first hierarchical layer represent operating states which the internal combustion engine of the first type has in common with an internal combustion engine of a different type, and wherein the second hierarchical layer and all additional hierarchical layers subordinated to the second hierarchical layer represent operating states which are specific to the internal combustion engine of the first type.

5. The method as recited in claim 4, wherein the plurality of differently-ranked hierarchical layers include at least the following operating states:

| hierarchical layer n = | operating states |
|---|---|
| 1 | "engine trigger" |
| 2 | "standby" |
| | "start" |
| | "normal operation" |
| | "after-run" |
| 3 | "ready" |
| | "start phase" |
| | "idle" |
| | "accelerate" |
| | "coast" |
| | "end" |
| 4 | "preheat" |
| | "no preheat" |

wherein the "standby," "start," "normal operation," and "after-run" operating states are sub-states of the "engine trigger" operating state, and wherein the "idle" and "accelerate" operating states are substates of the "normal operation" operating state, and wherein the "coast" and "end" operating states represent sub-states of the "after-run" operating state, and wherein the "preheat" and "no preheat" states are sub-states of the "ready" operating state, and wherein hierarchical layers n=1, 2 and 3 represent operating states which the internal combustion engine of the first type has in common with the internal combustion engine of a different type, and wherein hierarchical layer n=4 represents operating states that are specific to the internal combustion engine of the first type.

6. The method as recited in claim 5, wherein, within hierarchical layer n=3, a transition between the "idle" state and the "accelerate" state of the internal combustion engine of the first type is facilitated, depending on a command of a driver of a vehicle that includes the internal combustion engine of the first type.

7. The method as recited in claim 5, wherein, within hierarchical layer n=3, the internal combustion engine of the first type transitions from the "coast" state into the "end" state only when an ignition for the internal combustion engine of the first type is turned off and the rotational speed of the engine has become less than a third threshold value near zero.

8. The method as recited in claim 5, wherein, within hierarchical layer n=3, the internal combustion engine of the first type transitions from the "ready" state to the "start phase" state only when starting of the engine by a starter is recognized, and transition from the "start phase" state back to the "ready" state only when the rotational speed of the engine is less than a first predefined threshold value for a predefined time period.

9. The method as recited in claim 8, wherein, within hierarchical layer n=2, the internal combustion engine is initially in the "standby" state before transitioning from the "standby" state into the "ready" state when an ignition for the internal combustion engine of the first type is turned on.

10. The method as recited in claim 5, wherein, within hierarchical layer n=2, the internal combustion engine of the first type transitions from the "start" state directly to the "after-run" state when one of: a) an ignition for the internal combustion engine of the first type is turned off; and b) an information indicating turn-off of the ignition is supplied to a control unit for the engine.

11. The method as recited in claim 10, wherein, within from one of the "ready" state and the "start phase" state to the "coast" state when one of: a) the ignition for the internal combustion engine of the first type is turned off; and b) an information indicating turn-off of the ignition is supplied to the control unit for the engine.

12. The method as recited in claim 5, wherein, within hierarchical layer n=2, the internal combustion engine of the first type transitions from the "start" state directly to the "normal operation" state when the rotational speed of the engine exceeds a predefined second threshold value.

13. The method as recited in claim 12, wherein, within hierarchical layer n=3, the internal combustion engine of the first type transitions from the "start phase" state to the "idle" state when the rotational speed of the engine exceeds the predefined second threshold value.

14. The method as recited in claim 5, wherein, within hierarchical layer n=2, the internal combustion engine of the first type transitions from the "normal operation" state directly to the "start" state when the rotational speed of the engine drops below a predefined first threshold value.

15. The method as recited in claim 14, wherein the internal combustion engine of the first type transitions from the "normal operation" state in hierarchical layer n=2 into the "ready" state in hierarchical layer n=3 when the rotational speed of the engine drops below the first threshold value.

16. The method as recited in claim 5, wherein, within hierarchical layer n=2, the internal combustion engine of the first type transitions from the "after-run" state, directly to the "start" state when an ignition for the internal combustion engine is turned on again.

17. The method as recited in claim 16, wherein, within hierarchical layer n=3, when the ignition is turned on again, the internal combustion engine of the first type transitions from one of the "coast" state and the "end" state into the "ready" state, and when the "after-run" state is terminated, the internal combustion engine of the first type transitions from one of the "coast" state and the "end" state into the "standby" state.

18. The method as recited in claim 5, wherein the state machine defines different operating states of an engine control unit for the internal combustion engine of the first type in addition to the operating states of the internal combustion engine of the first type.

19. The method as recited in claim 18, wherein hierarchical layer n=1 further includes states of "off," "reset,"

"boot," "initialize" and "shut down" for the engine control unit, in addition to the "engine trigger" state for the internal combustion engine of the first type.

20. The method as recited in claim 19, wherein the engine control unit transitions from the "off" state to the "reset" state when the engine control unit is switched on.

21. The method as recited in claim 19, wherein a transition from the "standby" state for the internal combustion engine of the first type into the "shut down" state for the engine control unit takes place according to a predefined condition.

22. The method as recited in claim 19, wherein, in hierarchical layer n=1, a transition from the "initialize" state to the "engine trigger" state takes place when initialization is completed.

23. The method as recited in claim 22, wherein, if initialization has been completed, a transition from the "initialize" state into one of the "standby" state and the "start" state in hierarchical level n=2 takes place, and wherein if the transition into the "start" state takes place, a further transition takes place directly to the "ready" state in hierarchical layer n=3.

24. The method as recited in claim 19, wherein, when an ignition for the internal combustion engine of the first type is turned on again, a transition takes from the "after-run" state, in which the ignition is off, into one of the "reset" state, the "boot" state, and the "initialize" state.

25. The method as recited in claim 24, wherein the "boot" state includes sub-states "standard boot," "customer boot" and "operating system preparation" that are assumed sequentially during booting of the engine control unit.

26. The method as recited in claim 24, wherein the "initialize" state includes sub-states "pre-initialize," "rotational speed initialize" and "post-initialize" that are assumed sequentially during initialization of the engine control unit.

* * * * *